United States Patent [19]

Ohba et al.

[11] Patent Number: 4,985,730

[45] Date of Patent: Jan. 15, 1991

[54] METHOD OF DEELECTRIFICATION IN AN ELECTROPHOTOGRAPHIC APPARATUS

[75] Inventors: Hiroki Ohba, Yokohama; Makoto Koshi, Kawasaki; Norihiro Kumasaka, Fukushima, all of Japan

[73] Assignee: Fujitsu Limited, Kawasaki, Japan

[21] Appl. No.: 396,877

[22] Filed: Aug. 22, 1989

[30] Foreign Application Priority Data

Aug. 29, 1988 [JP] Japan ..... 63-214391
Aug. 31, 1988 [JP] Japan ..... 63-217700

[51] Int. Cl.[5] ..... G03G 21/00; G03G 15/02

[52] U.S. Cl. ..... 355/208; 355/204; 355/219

[58] Field of Search ..... 355/219, 216, 316, 317, 355/204, 208, 315, 311, 273, 274

[56] References Cited

U.S. PATENT DOCUMENTS 4,355,885 10/1982 Nagashima ..... 355/219 X
4,375,328 3/1983 Tsuchiya et al. ..... 355/210
4,511,240 4/1985 Suzuki et al. ..... 355/219 X
4,540,270 9/1985 Imanaka et al. ..... 355/208 X
4,659,209 4/1987 Yamada ..... 355/214
4,750,019 6/1988 Kamitani ..... 355/274
4,785,324 11/1988 Yamazaki et al. ..... 355/297

*Primary Examiner*—A. T. Grimley
*Assistant Examiner*—Nestor R. Ramirez
*Attorney, Agent, or Firm*—Armstrong, Nikaido, Marmelstein, Kubovcik & Murray

[57] ABSTRACT

An electrophotographic recording apparatus comprising a rotatable photosensitive drum and unit for electrifying the drum, depositing an electrostatic latent image on the drum, developing the latent image, transferring the image on the drum to printing paper, and optical-deelectrifying the drum. In this method, the optical deelectrification unit is located at a position opposite to the drum with respect to a passage of the printing paper, and an optical deelectrification beam is irradiated to the drum only when the printing paper interrupts an optical path of the deelectrification light toward the drum.

9 Claims, 10 Drawing Sheets

1
START SIGNAL
NO
YES
FLAG ON ?
YES
2
PRE-ELECTRIFICATION
NO
3
MOTOR DRIVE ON
SENSOR 8 ON ?
NO
YES
MOTOR DRIVE OFF
READY SIGNAL
4
NORMAL PRINTING OPERATION
5
MOTOR DRIVE OFF
NO
YES
TIMER T SET
6
YES
START SIGNAL
NO
7
NO
NO
t = 0
YES
FLAG SET

DIFFERENCE > B: PROBLEM
DIFFERENCE < B: NO PROBLEM

METHOD OF DEELECTRIFICATION IN AN ELECTROPHOTOGRAPHIC APPARATUS

BACKGROUND OF THE INVENTION

1. Field of the Invention

This invention relates to a method of controlling an optical-deelectrification in an electrophotographic recording apparatus, such as a printer, facsimile, or copying machine, having a photosensitive drum which is deelectrified by an optical irradiation thereto. This invention also relates to a method of pre-electrification in the same kind of electrophotographic recording apparatus.

2. Description of the Related Art

An electrophotgraphic recording apparatus is widely used in various printers, facsimiles, or copying machines, and such an electrophotgraphic recording apparatus includes many processing units, such as a photosensitive drum, a front electrification unit, a developing unit, a photo-depositing unit, a deelectrification unit, and a cleaner, and therefore, such an apparatus must have a large size. On the other hand, there is a strong demand for a reduction of the size of such an apparatus due to the current trend toward smaller office automation facilities.

To reduce the size of such an electrophotographic recording apparatus, the respective processing units must be made compact and effectively arranged in the apparatus, and in this connection, a deelectrification unit can be more freely arranged than other units. Therefore, there is a demand for a small-sized optical-deelectrification unit. Note, this unit must be sometimes arranged at a position from which an optical-deelectrification beam is not directly irradiated to the photosensitive drum, but is irradiated to the drum via a printing media.

SUMMARY OF THE INVENTION

An object of the present invention is to provide an optical-deelectrification control method in an electrophotographic recording apparatus, in which the voltage on the electrified surface of the photosensitive drum is not changed even if the drum is photo-deelectrified through a printing media, to obtain stable and high quality printed products.

Another object of the present invention is to provide a method of pre-electrification in the same kind of electrophotographic recording apparatus, in which the voltage on the photosensitive drum can be always maintained at a desired high level.

According to the present invention, there is provided a method of controlling an optical-deelectrification in an electrophotographic recording apparatus, the apparatus comprising a rotatable photosensitive drum, a front electrification unit for electrifying the photosensitive drum, a photo-depositing unit for depositing an electrostatic latent image on the photosensitive drum, a developing unit for developing the latent image, a transfer electrification unit for transferring the image to printing media, an optical-deelectrification unit for deelectrifying the photosensitive drum, and a means of defining a passage of the printing media. The apparatus is characterized in that the optical deelectrification unit is located at a position opposite said photosensitive drum with respect to the passage of printing media, and an optical deelectrification beam is irradiated from the optical deelectrification unit to said photosensitive drum only when the printing media interrupts an optical path of the deelectrification beam toward the photosensitive drum.

According to another aspect of the present invention, there is provided a pre-electrification method in an electrophotographic recording apparatus, the apparatus comprising a rotatable photosensitive drum and, along a rotational circumferential direction of the the drum, a front electrification unit for electrifying the photosensitive drum, a photo-depositing unit for depositing an electrostatic latent image on the photosensitive drum, a developing unit for developing the latent image, a transfer electrification unit for transferring the image to printing media, and a control means for effecting a printing operation according to a print start signal; this method is characterized in that, when the print start signal is received, a period from the time at which a previous printing operation has finished is measured, and if this measured period is larger than a predetermined period, the photosensitive drum is pre-electrified by the front electrification unit for at least one revolution of the photosensitive drum, before the printing operation is started.

DESCRIPTION OF THE PREFERRED EMBODIMENTS

Figure 1A:
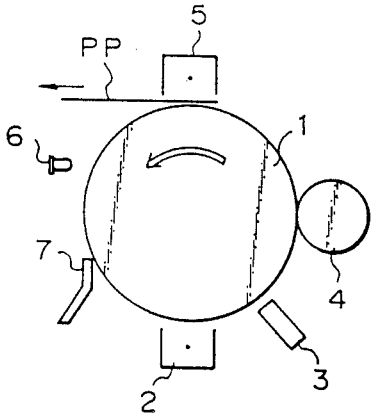
Fig. 1A PRIOR ART
FIGS. 1A to 1C are schematic illustrations for explaining an operation of an electrophotographic recording apparatus known in the prior art.

Referring now to FIG. 1A, an electrophotographic recording apparatus includes a rotating photosensitive media or member, such as a drum or belt 1 which is electrified by a front electrification unit 2. A photodepositing unit 3 has a depositing element, such as a light emission diode (LED), to form on the photosensitive drum 1 an electrostatic latent image which is developed by a developing unit or sleeve 4. The toner image on the photosensitive drum 1 is transferred to a printing media or paper PP by a transfer electrification unit 5, and then the photosensitive drum 1 is deelectrified by an optical deelectrification unit 6 having an optical deelectrification element, such as a light emission diode (LED). The photosensitive drum 1 is then cleaned by a cleaner 7.

As shown in FIG. 1A, if the optical deelectrification unit 6 could be located at any position, preferably the unit 6 would be arranged at a position, from which a deelectrification laser beam is directly irradiated to the drum 1, to obtain an effective deelectrification.

Nevertheless, to reduce the size of such an electrophotographic recording apparatus, it is sometimes necessary to rearrange the respective processing units, but it is almost impossible to substantially change the locations of all of the units, except for the deelectrification unit 6, due to the particular functions of these units. This means that the deelectrification unit 6 must be sometimes located at a position of which the unit 6 does not interfere with the other units, such as a position opposite to the printing paper PP, from where a deelectrification laser beam is not directly irradiated to the photosensitive drum 1 but is irradiated to the drum 1 via the printing paper PP, as shown in FIG. 1B.

Figure 1B:
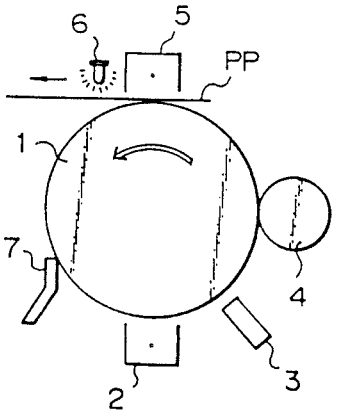
Fig. 1B PRIOR ART
Figure 1C:
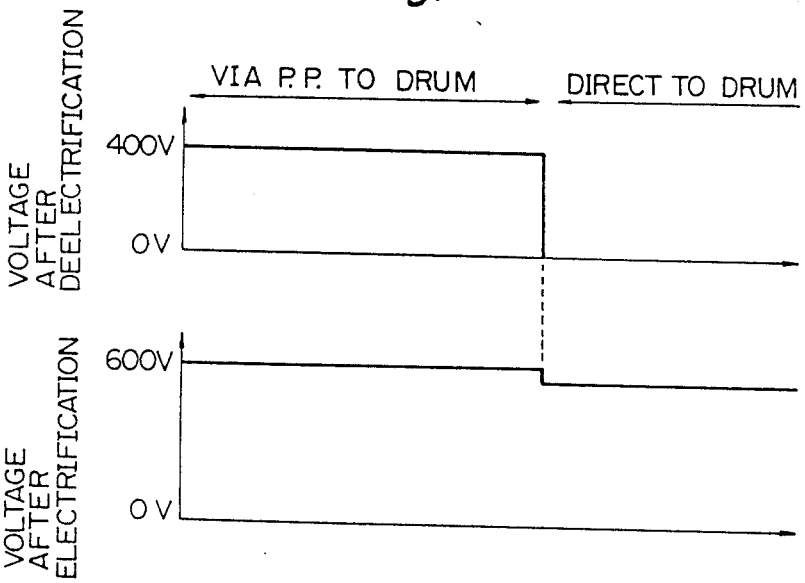

In the arrangement as shown in FIG. 1B, if the photosensitive drum 1 is always irradiated with the deelectrification optical beam from the unit 6, a voltage at the surface of the drum 1 is reduced to about 400 V when a deelectrification optical beam is irradiated through the printing paper PP, but on the other hand, a voltage at the surface of the drum 1 is greatly reduced to nearly 0 V when a deelectrification optical beam is directly irradiated to the drum 1 and is not transmitted through the printing paper PP. Thus the drum surface has two parts; one at which the voltage is greatly reduced and another at which the voltage is less reduced, as shown in FIG. 1C.

Therefore, after the drum 1 is again electrified by the front electrification unit 2, the voltage on the drum surface to which the deelectrification optical light has been irradiated through the printing paper PP can be raised nearly to a saturated voltage of 600 V. On the other hand, the voltage on the drum surface to which the deelectrification optical beam has been directly irradiated is raised only to a value such as 550 V, which is lower than the saturated voltage, as shown in FIG. 1C. Due to such a voltage unbalance on the electrified drum surface, the lower voltage printed areas on the drum surface will be dark and will sometimes be shaded off.

To prevent such a large voltage reduction on the surface of the drum, it is sometimes preferable to reduce the amount of the deelectrification beam to prevent an excess voltage reduction on the drum surface, even if the deelectrification beam is directly irradiated to the drum.

One method of realizing this is to reduce the intensity of the deelectrification beam from the deelectrification unit itself, by reducing an actuating voltage of small-sized deelectrification lamps (LED) or using LEDs having a lower output power. This method, however, is not practical because a reduction of the amount of deelectrification beam is naturally limited to some extent.

Another method is to reduce the number of deelectrification lamps (LED) from n to m ($m<n$), to reduced the total illumination of deelectrification beam. But this method is not preferable in that the amount of beam becomes uneven with respect to the axial direction of the photosensitive drum, if a plurality of such lamps are spacedly arranged along the axial direction thereof.

Still another method is to remove the deelectrification unit itself, and not conduct such a deelectrification. But, according to the photosensitivity of the drum used for this purpose, the drum may be worn out after long term usage, so that the sensitivity or clearness of the printed products will be reduced.

Figure 2A:
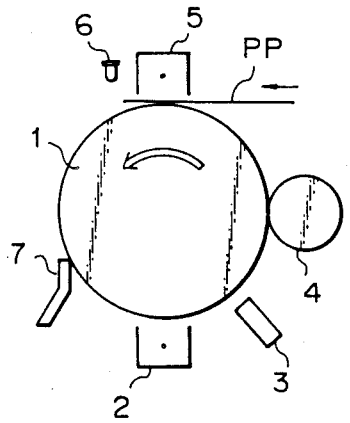
FIGS. 2A to 2C show a principle of a method of deelectrification of an electrophotographic recording apparatus according to the present invention.
Figure 2B:
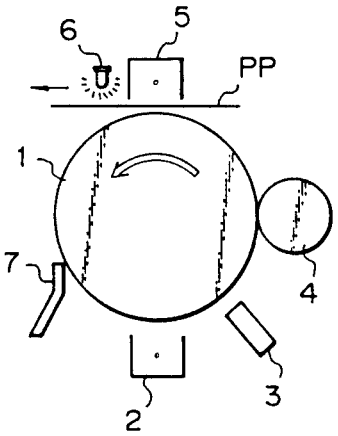
Figure 2C:
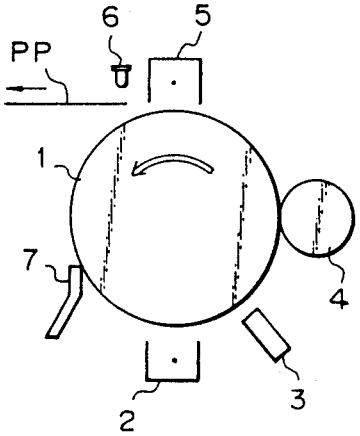

FIG. 2A to 2C show a principle of this invention. A rotating photosensitive drum 1 is electrified by a front electrification unit 2. A photo-depositing unit 3 is provided with a depositing element to form on the photosensitive drum 1 an electrostatic latent image which is developed by a developing unit 4. The image on the photosensitive drum 1 is transferred to a printing media PP by a transferring unit 5. Then, the photosensitive drum 1 is deelectrified by an optical deelectrification unit 6.

According to the present invention, the optical deelectrification unit 6 is located at a position opposite to the photosensitive drum 1 with respect to a passage of the moving printing media PP, as shown in FIG. 2A. A sensor (not shown in FIGS. 2A–2C) is provided for detecting whether the printing media PP passes through the optical deelectrification unit 6, and the optical deelectrification unit 6 is controlled to irradiate an optical deelectrification beam to deelectrify the photosensitive drum 1 only when the moving printing media PP interferes with an optical path from the optical deelectrification unit 6 to the photosensitive drum 1, as shown in FIGS. 2B and 2C.

Figure 3:
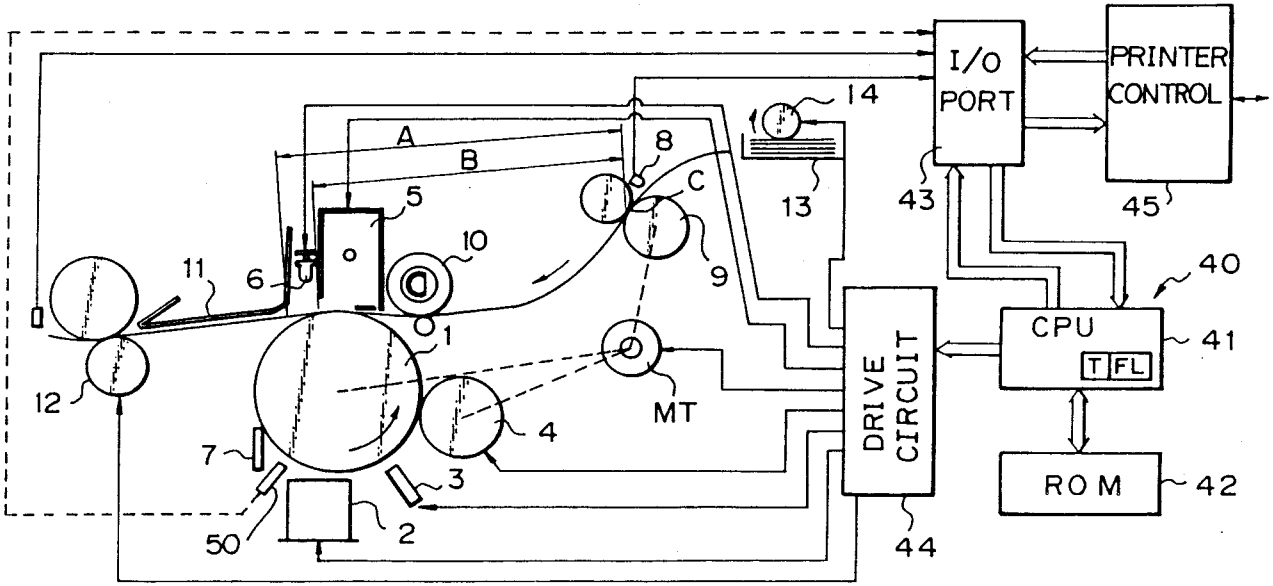
FIG. 3 illustrates an embodiment of an electrophotographic recording apparatus of this invention.

FIG. 3 illustrates an embodiment of an electrophotographic recording apparatus according to the present invention, in which the same parts as shown in FIG. 1 are indicated by the same reference numeral. A media sensor 8 is provided for detecting the printing media PP, which is picked up by a pickup roller 14 from the hopper 13 and moved by feed rollers 9 in a direction shown by an arrow. The printing media PP is then moved through and guided by a transfer guide roller 10 during a transfer operation at the transfer unit 5. Then, the printing media PP is moved through a guide member 11 and the toner image transferred to the printing media PP is fixed by fixing rollers 12.

Figure 4A:
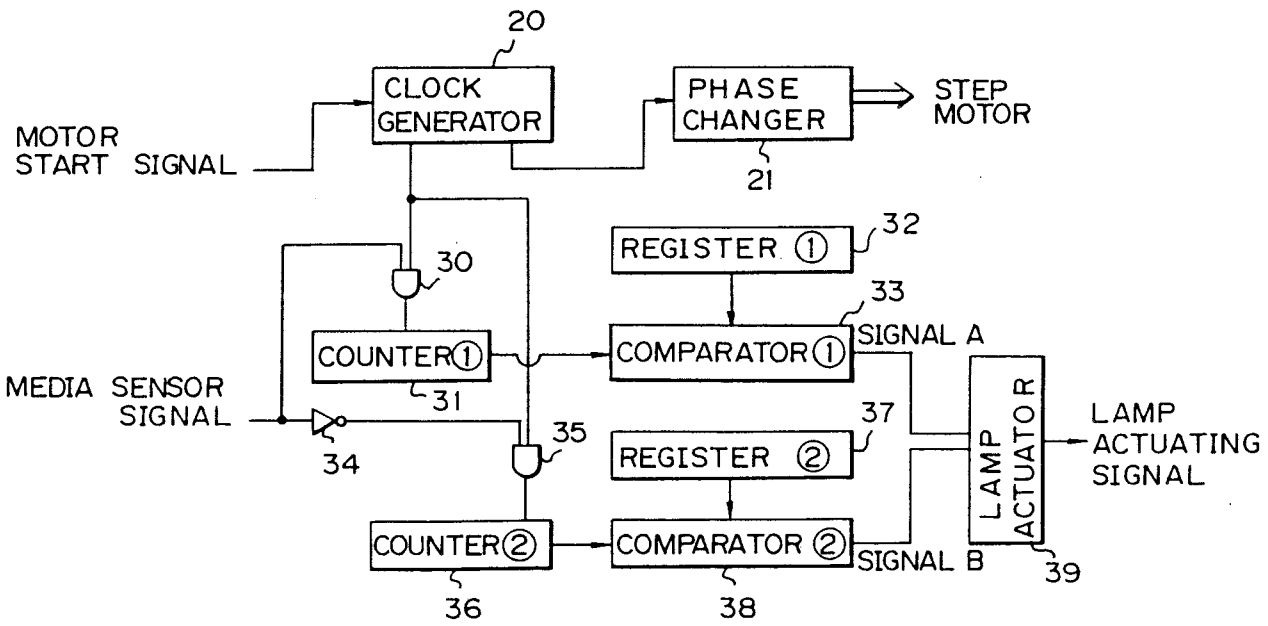
FIG. 4A is a block diagram illustrating a circuit for controlling the optical-deelectrification unit.
Figure 4B:
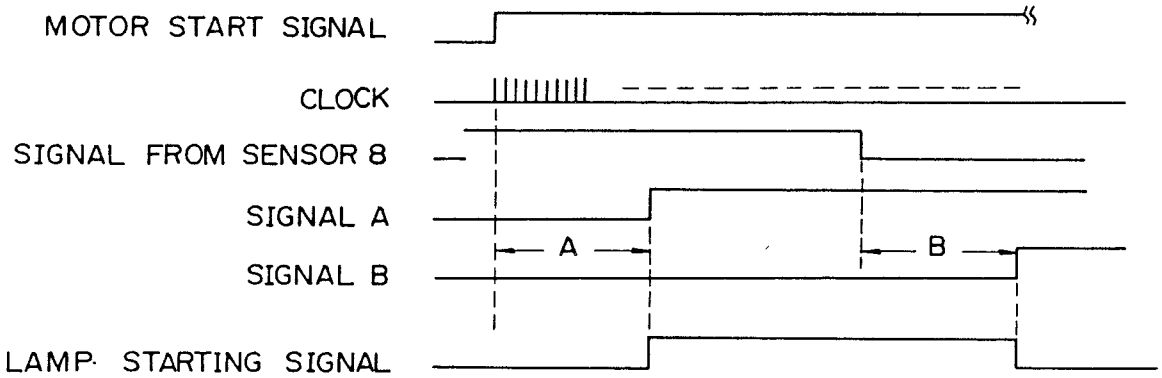
FIG. 4B shows wave shapes of signals at various positions in the circuit of FIG. 4A.

FIG. 4A is a block diagram illustrating a circuit for controlling the optical-deelectrification unit 6 according to this invention. Such a circuit is included as a part of the CPU 41 shown in FIG. 3. FIG. 4B is a diagram illustrating the wave shapes in various positions. A clock generator 20 generate clock signals for actuating step motors to drive the various parts of this electrophotographic recording apparatus, such as the feed rollers 9, the photosensitive drum 1, the developing sleeve 4, the fixing rollers 12, and so on, and a phase changing means 21 changes the phase of the step motors according to the clock signals.

When a signal from the media sensor 8 is ON, an AND gate 30 opens to output the clock signal from the clock generator 20, and a first counter 31 counts the clock signal from the AND gate 30. A first register 32 is used for registering a first reference value (a) corresponding to a distance A (FIG. 3) from a point C to the left end of the optical-deelectrification unit 6, and a first comparator 33 compares the counted value of the first counter 31 and the first reference value (a) of the first register 32 to output a lamp ON signal (A).

An inverter 34 inverts the media sensor signal from the media sensor 8. When the output signal from the inverter 34 is ON (i.e., when the media sensor signal is OFF), an AND gate 35 opens to output the clock signal from the clock generator 20, and a second counter 36 counts the clock signal from the AND gate 35. A second register 37 is used for registering a second reference value (b) corresponding to a distance B (FIG. 3) from a point C to the right end of the optical-deelectrification unit 6, and a second comparator 38 compares the counted value of the second counter 36 and the second reference value (b) of the second register 37 to output a lamp OFF signal (B). A lamp actuating circuit 39 outputs to the optical-deelectrification unit 6 a lamp actuating signal which is turned ON by the lamp ON signal (A) and OFF by the lamp OFF signal (B).

In the above-mentioned embodiment, with respect to the optical-deelectrification unit 6, the leading end of the printing media PP is detected by the counter 31, register 32, and comparator 33, and the trailing end thereof is detected by the counter 36, register 37, and comparator 38.

An operation of this apparatus will now be described with reference to FIGS. 3, 4A, and 4B. The printing media PP is picked up by a pickup roller 14 from the hopper 13 and detected when it passes through the media sensor 8. When the leading edge of the printing media PP arrives at a point C in FIG. 3, the printing media PP once stops. Then, when a motor actuating signal is received, the clock generator 20 generates a clock signal to actuate the step motors via the phase changing means 21, and thus the feed rollers 9 are again driven to further feed the printing media PP. At this time, since the signal of the media sensor 8 is ON, the first AND gate 30 opens and the second AND gate 35 is closed, and therefore, the first counter 31 counts a driving clock from the clock generator 20. The first comparator 33 compares the counted value of the first counter 31 and the first reference value (a) of the first register 32 corresponding to a distance A.

The distance A is a distance through which the printing media PP travels from the feed rollers 9 to the optical-deelectrification unit 6, so that only an optical-deelectrification beam transmitted through the printing media PP is irradiated to the photosensitive drum 1.

Therefore, when the leading edge of the printing media PP is moved by the distance A, a lamp ON signal (A) is output from the first comparator 33 to the lamp actuating circuit 39, which outputs a lamp driving signal to turn ON the LED of the optical-deelectrification unit 6.

When the printing media PP is further moved, and thus the tailing end thereof passes the media sensor 8, a media detection signal is turned OFF to close the AND gate 30 and open the AND gate 35, and thus the second counter 36 counts a driving clock from the clock generator 20. The second comparator 38 compares the counted value of the second counter 36 and the second reference value (b) of the second register 37 corresponding to a distance B. This distance B is a distance through which the tailing end of the printing media PP travels from the media sensor 8 to a position just before the optical-deelectrification unit 6. Therefore, the optical-deelectrification beam is irradiated until just before the tailing end of the printing media PP reaches the optical-deelectrification unit 6.

Therefore, when the trailing end of the printing media PP is moved by a distance B from the position C, a lamp OFF signal (B) is output from the second comparator 38 to the lamp actuating circuit 39 to turn OFF the lamp driving signal and stop the irradiation from the optical-deelectrification unit 6.

During this operation, the front electrification unit 2 electrifies the photosensitive drum 1 and an image is deposited on the drum 1 by the photo-depositing unit 3. The developing sleeve 4 develop a toner image, which is transferred to the printing media PP by the transfer electrification unit 5 and then fixed by the fixing rollers 12.

As mentioned above, according to the present invention, the optical-deelectrification unit 6 is controlled so that the optical-deelectrification beam is not directly irradiated to the photosensitive drum 1, but is irradiated thereto only through the printing media PP, because the clock signal from the clock generator 20 for driving the step motors is counted by the counters 31 and 36, and the leading and trailing edges of the printing media PP (i.e., the distance through which the printing media PP travels from the point C) are detected.

Therefore, the optical-deelectrification beam is not directly irradiated to the photosensitive drum 1 and thus an excess reduction of the voltage on the surface of the photosensitive drum 1 is prevented, so that the photosensitive drum 1 can easily be raised to a saturated voltage (such as, 600 V) when electrified by the front electrification unit 2. Therefore, the voltage of the electrified drum 1 becomes uniform over the entire surface thereof, and good quality printed products can be obtained.

While the invention has been particularly shown and described in reference to preferred embodiments thereof, it will be understood by those skilled in the art that changes in form and details may be made therein without departing from the spirit and scope of the invention.

Figure 5A:
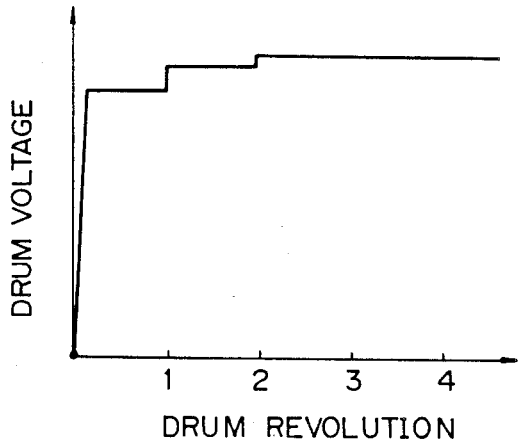
FIGS. 5A and 5B show the relationships between the revolutional number of a photosensitive drum and a voltage on a surface of the drum.
Figure 5B:
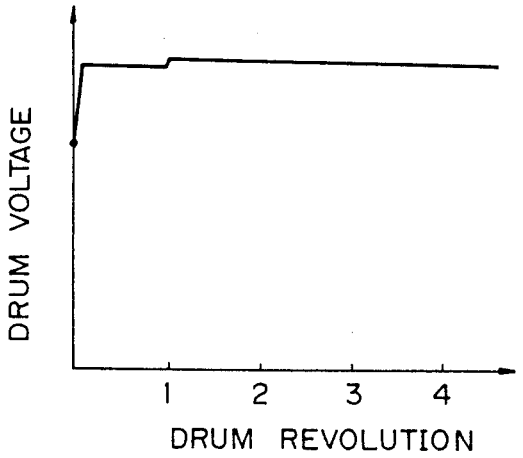

FIGS. 5A and 5B show the relationships between the revolutional number of a photosensitive drum and a voltage on a surface of the drum which is electrified by a front electrification unit. If the apparatus has no deelectrification unit, or if the photosensitive drum cannot be fully deelectrified by a deelectrification unit, the voltage on the surface of the drum just before the front electrification unit is not always reduced to a required value. For example, if a print start signal is received a short time after the previous printing operations is finished, the voltage of the drum just before the front electrification unit is relatively high. On the other hand, if such a signal is received a long time after the previous printing operation is finished, the voltage of the drum just before the front electrification unit is reduced to almost 0 V. Thus, depending on the time at which the printing operation is stopped, the voltage of the drum just before the front electrification unit is significantly changed.

Therefore, if the voltage of the drum is reduced to almost 0 V, i.e., if the initial voltage is low, the drum cannot reach a saturated voltage even if the drum is once electrified (one revolution), and the voltage thereof, must be raised step by step during several revolutions of the drum, as shown in FIG. 5A. If, however, the voltage of the drum is relatively high, the drum can reach almost a saturated voltage when the drum is once electrified (one revolution), as shown in FIG. 5B.

In the case of FIG. 5A, if a printing operation must be started although the drum has not still reached saturated voltage, the printed area will be dark and sometimes, shaded off, which affects the printing quality.

Figure 6A:
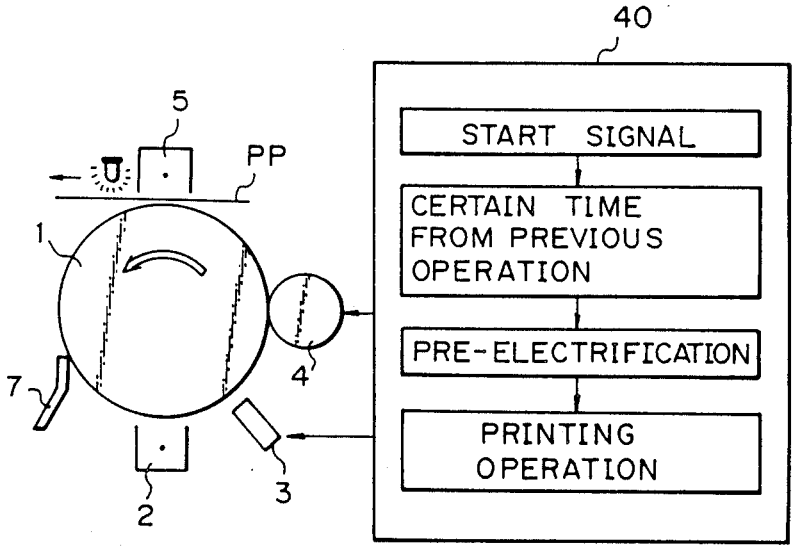
FIG. 6A shows a principle of another embodiment of an electrophotographic recording apparatus of this invention.

FIG. 6A illustrates a principle of an embodiment of this invention. In FIG. 6A, the same reference numerals as used in FIGS. 2A-2C indicate the same parts of the apparatus, except that this embodiment is provided with a control means 40. When a print start signal is received, a check is carried out to detect whether or not a certain period has expired after the previous printing operation is finished. If a certain period has not expired since the previous printing operation, a pre-electrification is conducted before the printing operation is again started.

Figure 6B:
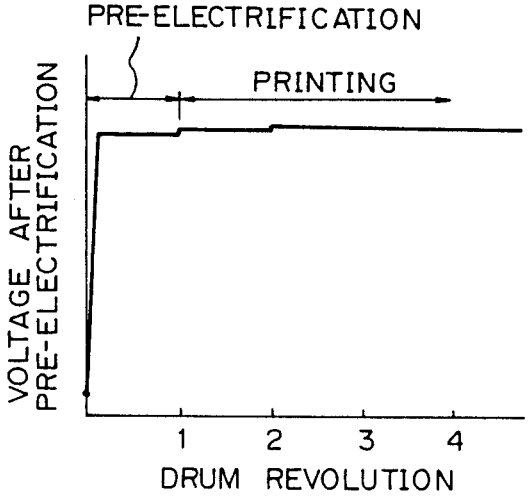
FIG. 6B shows a relationship between the revolutional number of a photosensitive drum and a voltage therof in the embodiment of FIG. 6A.

Therefore, as shown in FIG. 6B, depending on the period after the previous printing operation is finished, the photosensitive drum 1 is rotated for one or more revolutions without conducting a printing operation, and is only pre-electrified by the front electrification unit 2 for at least one revolution of the drum 1. Thus, the printing operation is started after the voltage of the photosensitive drum 1 is fully raised to a saturated value (such as 600 V).

Referring again to FIG. 3 the control means 40 comprises a processor (CPU) 41, having a timer T and a flag FL, for controlling the various parts of this electrophotographic recording apparatus by programs. A read memory (ROM) 42 memories the parameters or programs necessary for operating the CPU 41. Signals from the sensors 8 and 8a are input to an inlet/outlet port 43, which is also connected to the above-mentioned CPU 41 and a printer controller 45. A drive circuit 44 drives the front electrification unit 2, the photo-depositing unit 3, the developing sleeve 4, the motor MT, the transfer electrification unit 5, the optical deelectrification unit 6, and the fixing rollers 12 according to instructions from the CPU 20.

Figure 7A:
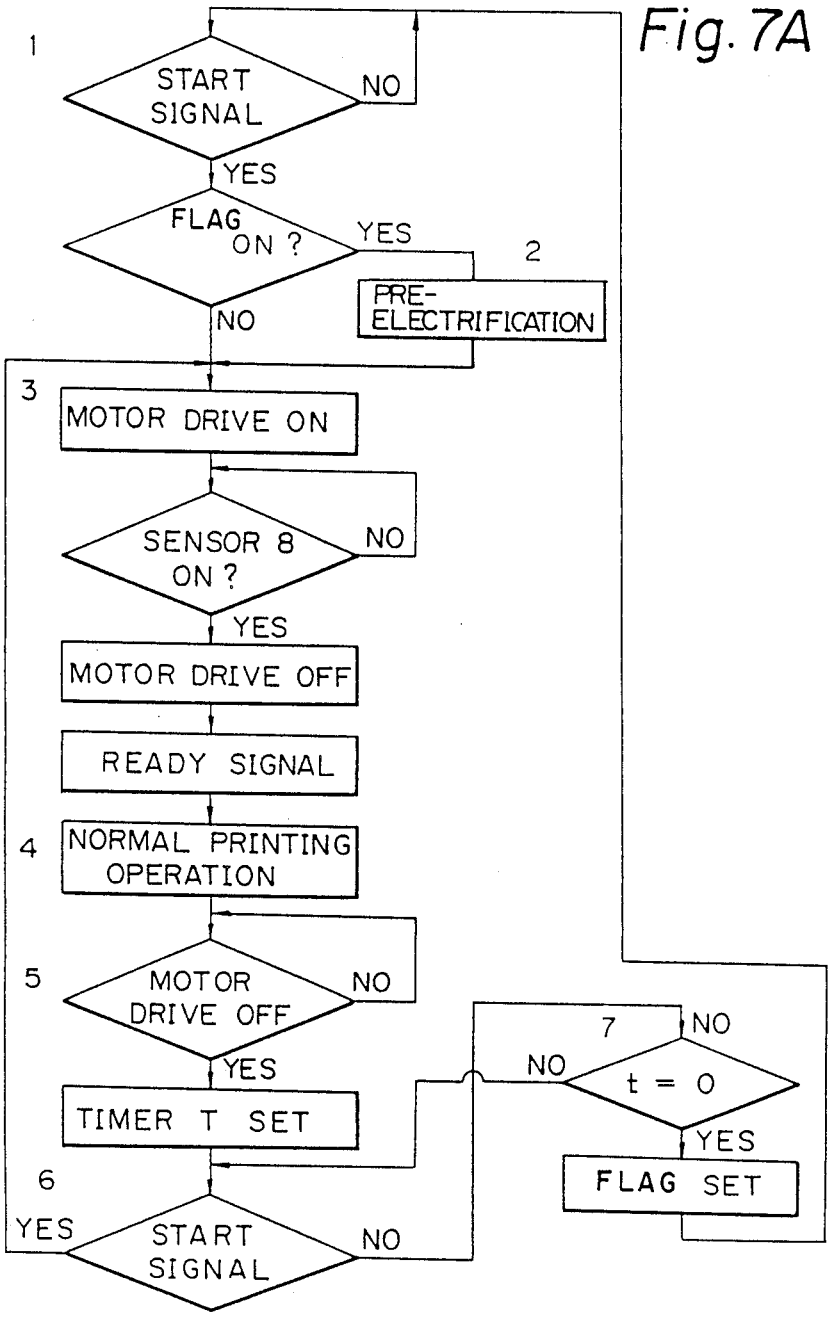
FIG. 7A is a flow chart for conducting a main process in the embodiment of FIG. 6A.
Figure 7B:
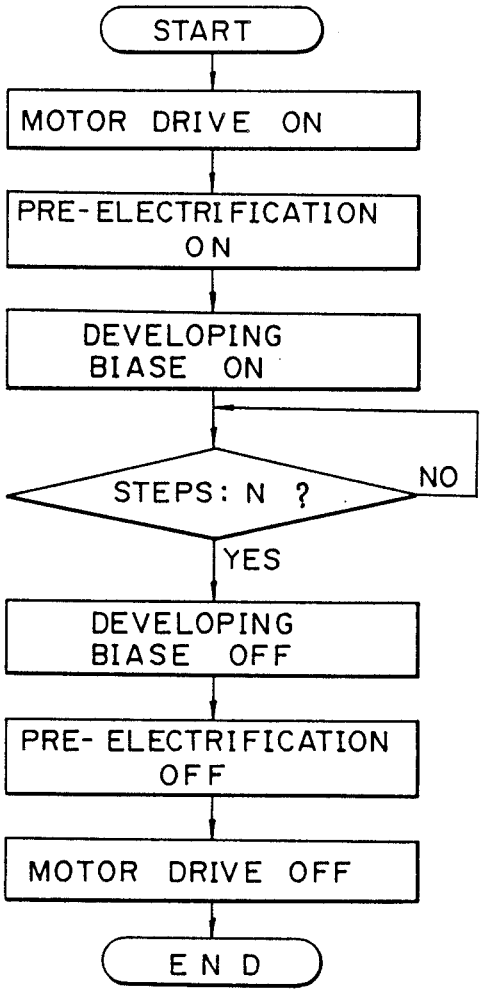
FIG. 7B is a flow chart for conducting a sub or preelectrification process in the embodiment of FIG. 6A.

FIG. 7A is a flow chart for conducting a main process according to the present invention, and FIG. 7B is a flow chart for conducting a sub-process or preelectrification process.

At step (1), the CPU 41 checks whether or not a print start signal has been received from the printer controller 45. After receiving a print command and print data, the controller 45 develops the print data to form print patterns and generates a print start signal when the preparation for printing is finished. After receiving the print start signal, the CPU 41 checks the flag FL.

At step (2), if the flag FL is ON, i.e., if a relatively long period has expired since the previous printing operation, the CPU 41 conducts a pre-electrification process as shown in FIG. 7B. First, the CPU turns on the motor driver of the drive circuit 44 to drive the motor MT, and thus the photosensitive drum 1, the developing sleeve 4, and so on are rotated. Then, the CPU turns on the front electrification unit 2 via the drive circuit 44 to conduct a pre-electrification process and turns on the bias for developing, whereby the photosensitive drum 1 is pre-electrified by the front electrification unit 2. The CPU 41 checks whether the step number of the step motor MT has reached N, i.e., whether the photosensitive drum 1 has been rotated for a certain number of (for example, two) revolutions. After two revolutions of the drum 1, the CPU turns off the bias for developing and turns off the front electrification unit 2. Also, the motor driver is turned off to stop the motor MT to finish the preelectrification process.

At step (3), if the flag FL is OFF, or if the flag FL is ON but the pre-electrification process (2) as mentioned above has finished, the actuator 44 turns on the motor driver to rotate the motor MT. At the same time, a clutch (not shown) of the hopper 13 is turned on, so that only the pickup roller 14 of the hopper is rotated by the motor MT to pickup the printing pattern from the hopper 13 and feed it to the feed roller 9. The CPU 41 checks whether the output signal form the sensor 8 is ON or OFF. If the signal is ON, i.e., if the printing paper has been fed to the feed roller 9 (at a waiting position), a set for printing paper is finished and thus the motor driver is turned off to stop the motor MT. The CPU 41 outputs to the printer controller 45, via the in/out port 43, a ready signal instructing that a preparation for printing is finished At step (4), the printer controller 45 outputs the print instructions and print pattern data to the CPU 41 via the in/out port 43. The CPU 41 turns on the motor driver of the actuator 44 to drive the motor MT to rotate the photosensitive drum 1, the developing unit 4, the feed rollers 9, and the fixing rollers 12. Also, the front electrification unit 2 is turned on and the bias for developing, the transfer electrification unit 5, the optical deelectrification unit 6 and the fixing rollers 12 are turned on. Thus, the photodepositing unit 3 is driven according to the print pattern data to form a toner image on the photosensitive drum 1, which is then transferred to the printing media PP fed by the feed rollers 9 and fixed at the fixing rollers 12 as a usual printing operation.

When the sensor 8a detect that the printing media PP is discharged, the CPU 41 stops the actuator 44 to stop various parts of this printing apparatus, and thus the printing operations is finished.

At step (5), when the motor driver of the actuator 44 is turned off, the CPU 41 sets a predetermined time to the timer T and actuates the timer T.

At step (6), after the timer T is actuated, the CPU 41 checks whether a print start signal has been received from the printer controller 45. If such a signal has been received, the CPU 41 stops checking the timer and returns to step (3).

At step (7), contrary to the above, if such a signal has not been received, the CPU 41 checks whether the timer T has become 0. If the timer T has not become 0, the CPU 41 returns to step (6). On the other hand, if the timer T has become 0 , the CPU 41 sets the flag FL to return to step (1).

As mentioned above, the time from the motor driver off, i.e., the printing operation is stopped, until the next start signal is checked by the timer T. If this period exceeds a certain time, the flag FL is turned on, assuming that the voltage on the photosensitive drum 1 is reduced to almost 0 V. If the flag FL is still ON when a print actuation signal is received, the photosensitive drum 1 is pre-electrified by at least one revolution. Therefore, just before the printing operation is started, the voltage on the photosensitive drum 1 is always relatively high. This means that the photosensitive drum 1 is easily electrified to almost the saturated voltage by the front electrification unit 2 at a printing operation.

Figure 8A:
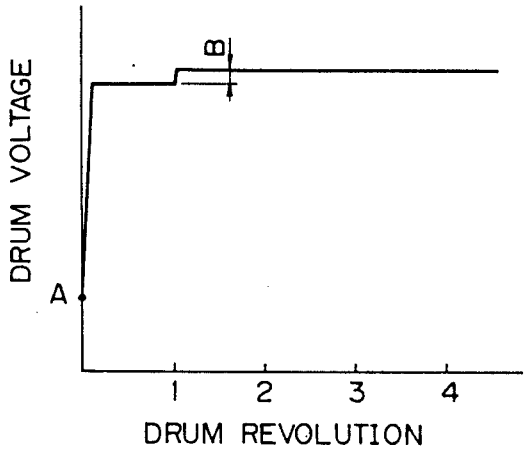
FIGS. 8A and 8B are diagrams for explaining how to determine a set time of the timer.
Figure 8B:
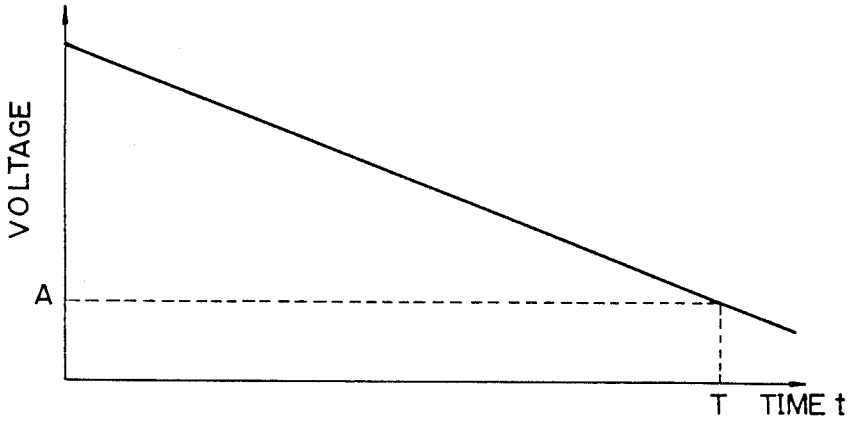

FIGS. 8A and 8B are diagrams for explaining how to determine a set time t of the timer T. As discussed above with reference to FIG. 5B, if a voltage remains on the photosensitive drum 1, a voltage difference is small between one revolution and two or more revolutions of the photosensitive drum 1, as shown in FIG. 5B. But if such a voltage difference is larger than B, as shown in FIGS. 5A or 8B, some problems will arise, such as the printed area will be dark and sometimes shaded off.

A critical voltage difference B can be determined by experiment, and thus an initial voltage A also can be determined. Before the photosensitive drum 1 is electrified by the front electrification unit 2, if an initial voltage of the drum 1 is lower than A, the voltage difference B will be large and causes difficulties . On the other hand, if the initial voltage of the photosensitive drum 1 is higher than A, the voltage difference B will be small and no problems will arise.

The dark attenuation characteristics of the photosensitive drum 1 can be measured and represented as FIG. 8B. The time T during which the voltage of the photosensitive drum 1 which has been initially electrified to a certain voltage is gradually reduced to A can be determined. In general, such a time T depends on the conditions in use of an individual photosensitive drum, particularly a life thereof or a humidity of the environment. Therefore, it would be preferable to determine the time T in a humid condition with an old photosensitive drum near to an end of its life, so that as small as possible a set time t of the timer T can be obtained.

In still another embodiment, a sensor 50 (FIG.3) is provided for detecting a voltage on the photosensitive drum 1 before the photosensitive drum 1 is electrified by the front electrification unit 2. If the measured voltage is lower than a predetermined value, i.e., if the voltage on the surface of the photosensitive drum 1 is reduced by more than a predetermined value, the photosensitive member 1 is pre-electrified by the front electrification unit 2 for at least one revolution of the photosensitive member, in the same manner as above.

What is claimed is:

1. A method of controlling an optical-deelectrification in an electrophotographic recording apparatus having a rotatable photosensitive member, said method comprising the steps of:

electrifying said photosensitive member;

depositing an electrostatic latent image on said photosensitive member;

developing said latent image;

transferring said image to printing media;

delectrifying said photosensitive member;

defining a passage of said printing media, wherein said step of deelectrifying said photosensitive member is by an optical deelectrification unit located at a position opposite said photosensitive member with respect to said passage of printing media; and irradiating an optical deelectrification light from said optical deelectrification unit to said photosensitive member only when said printing media interrupts an optical path of said deelectrification light toward said photosensitive member.

2. A method as set forth in claim 1, wherein said printing media is a cut sheet having a leading edge and a trailing edge.

3. A method as set forth in claim 2, wherein said optical deelectrification unit is turned on just after said leading edge of the cut sheet crosses said optical path of the deelectrification light and turned off just before said trailing edge of the cut sheet crosses said optical path of the deelectrification light.

4. A method as set forth in claim 1, wherein said optical deelectrification unit includes light emission diodes.

5. An electrophotographic recording apparatus, comprising:

a rotatable photosensitive member;

a front electrification unit for electrifying said photosensitive member;

a photo-depositing unit for depositing an electrostatic latent image on said photosensitive member;

a developing unit for developing said latent image;

a transfer electrification unit for transferring said image to printing media;

an optical deelectrification unit for deelectrifying said photosensitive member;

means for defining a passage of said printing media; wherein said optical deelectrification unit is located at a position opposite said photosensitive member with respect to said passage of said printing media; and a control means for controlling the irradiation of an optical deelectrification light from said optical deelectrification unit to said photosensitive member only when said printing media interrupts an optical path of said deelectrification light toward said photosensitive member.

6. An apparatus as set forth in claim 5, wherein said control means includes a sensor positioned upstream of said passage of said printing media for detecting said printing media, a first register for registering a first reference value corresponding to a first distance from said sensor to a position in front of said optical deelectrification unit and a second register for registering a second reference value corresponding to a second distance from said sensor to a position near said optical deelectrification unit.

7. A pre-electrification method in an electrophotographic recording apparatus having a rotatable photosensitive member, comprising the steps of:

electrifying said photosensitive member with a front electrification unit provided along a rotational circumferential direction of said member;

depositing an electrostatic latent image on said photosensitive member by an exposure means for outputting a light image;

developing said latent image;

transferring said image to printing media by a transfer electrification unit;

deelectrifying said photosensitive member;

controlling said step of deelectrifying said photosensitive member by deelectrifying said photosensitive member downstream of said transfer unit with respect to the rotational circumferential direction of said photosensitive member to thereby prevent direct deelectrification of said photosensitive member;

effecting a printing operation according to a print start signal;

when said print start signal is received, measuring a period from the time at which a previous printing operation is finished; and if said measured period is larger than a predetermined period, controlling the front electrification unit so as to pre-electrify the photosensitive member by said front electrification unit for at least one revolution of the photosensitive member, while said optical de-electrification unit and said exposure means are inoperative before a printing operation is started, and starting said printing operation after said pre-electrifying is performed.

8. A pre-electrification method in an electrophotographic recording apparatus having a rotatable photosensitive member, comprising the steps of:

electrifying said photosensitive member by a front electrification unit along a rotational circumferential direction;

depositing an electrostatic latent image on said photosensitive member;

developing said latent image;

transferring said image to printing media by a transfer electrification unit;

deelectrifying said photosensitive member by an optical deelectrification unit arranged downstream of said transfer unit with respect to the rotational circumferential direction of said photosensitive member;

effecting a printing operation according to a print start signal;

measuring a reduction of voltage on said rotatable photosensitive member before said photosensitive member is electrified by said front electrification unit; and if said measured voltage is lower than a predetermined value, controlling said front electrification unit so as to preelectrify the photosensitive member by said front electrification unit for at least one revolution of the photosensitive member, while said optical de-electrification unit is inoperative before a printing operation is started.

9. A pre-electrification device in an electrophotographic recording apparatus, said apparatus comprising:

a rotatable photosensitive member;

a front electrification unit along a rotational circumferential direction of said member for electrifying said member for electrifying said photosensitive member;

a photo-depositing unit for depositing an electrostatic latent image on said photosensitive member;

a developing unit for developing said latent image;

a transfer electrification unit for transferring said image to printing media;

a control means for effecting a printing operation according to a print start signal;

means for measuring a reduction of voltage on said rotatable photosensitive member before said photosensitive member is electrified by said front electrification unit; and means for controlling said front electrification unit so that said photosensitive member is pre-electrified by said front electrification unit for at least one revolution of said photosensitive member, if said measured voltage is lower than a predetermined value.

* * * * *